United States Patent [19]

Banta

[11] 4,263,347

[45] Apr. 21, 1981

[54] APPARATUS AND METHOD FOR MASKING SURFACES

[76] Inventor: Maynard A. Banta, 11291 Weatherby Rd., Los Alamitos, Calif. 90720

[21] Appl. No.: 22,857

[22] Filed: Mar. 22, 1979

[51] Int. Cl.[3] ..... B05D 1/32

[52] U.S. Cl. ..... 427/282; 118/505; 156/71; 156/187; 156/192; 156/247; 156/280; 156/324; 156/574; 156/577; 206/389; 206/813; 428/194; 428/906

[58] Field of Search ..... 427/282; 156/71, 187, 156/192, 247, 280, 324, 577, 574; 118/505; 428/12, 194, 906; 206/389, 813

[56] References Cited

U.S. PATENT DOCUMENTS

| | | | |
|---|---|---|---|
| 1,963,666 | 6/1934 | McCarthy et al. | 154/42 |
| 2,312,301 | 3/1943 | Turner et al. | 428/906 |
| 2,480,461 | 8/1949 | Gabrielson | 242/96 |
| 2,614,770 | 10/1952 | Gabrielson | 242/96 |
| 2,749,262 | 6/1956 | Wiser | 206/321 |
| 2,801,018 | 7/1957 | Yount | 217/3 |
| 2,802,217 | 8/1957 | Wilhoyle | 3/4 |
| 2,803,578 | 8/1957 | Holland | 428/194 |
| 3,017,020 | 1/1962 | Giles et al. | 428/194 |
| 3,787,271 | 1/1974 | Wahlquist | 156/534 |
| 3,826,441 | 7/1974 | Miles | 242/55.53 |
| 3,837,949 | 9/1974 | Eckart | 156/71 |
| 3,950,214 | 4/1976 | Pool et al. | 156/527 |
| 4,033,803 | 7/1977 | Coder | 156/71 |
| 4,054,482 | 10/1977 | Wahlquist | 156/523 |

*Primary Examiner*—Ronald H. Smith
*Assistant Examiner*—Janyce A. Bell
*Attorney, Agent, or Firm*—Gausewitz, Carr, Rothenberg & Edwards

[57] ABSTRACT

A roll of pretaped, laterally folded masking material is mounted on a dispenser which is attached to the leg-piece of one of a pair of stilts worn by masking workers. When the stilts are secured to the feet and legs of a worker, the dispenser supports the roll generally vertically alongside the worker's body with the taped end of the roll facing upwardly and positioned approximately at the level of his shoulder. To mask the walls in a room, the worker unrolls the folded material and fastens the tape continuously along the tops of the walls around the perimeter of the room while moving along the walls. The unrolled material is then cut from the roll and the portion below the tape attached to the walls is unfolded downwardly to completely mask the walls. To subsequently mask the floor, the worker attaches the taped edge of another length of the material along one wall to the free edge of the material already taped to that wall. The second length of material is then cut from the roll and its free edge is pulled away from the wall, unfolding the second length and a lower portion of the first length along the floor.

24 Claims, 10 Drawing Figures

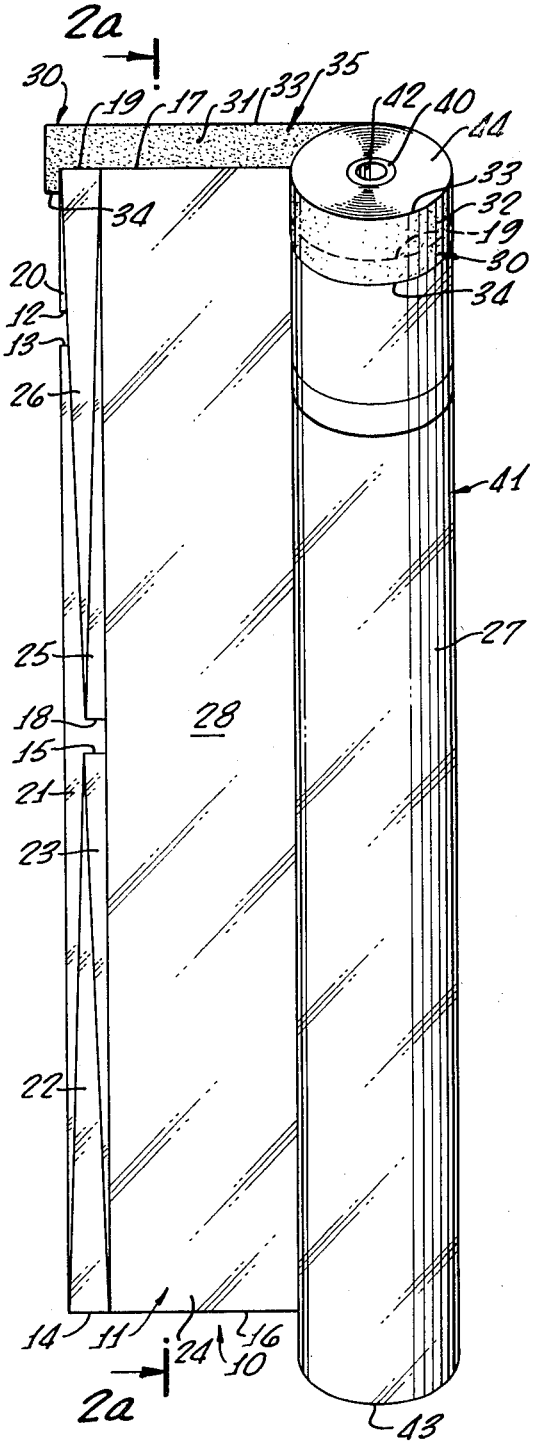
FIG. 1.
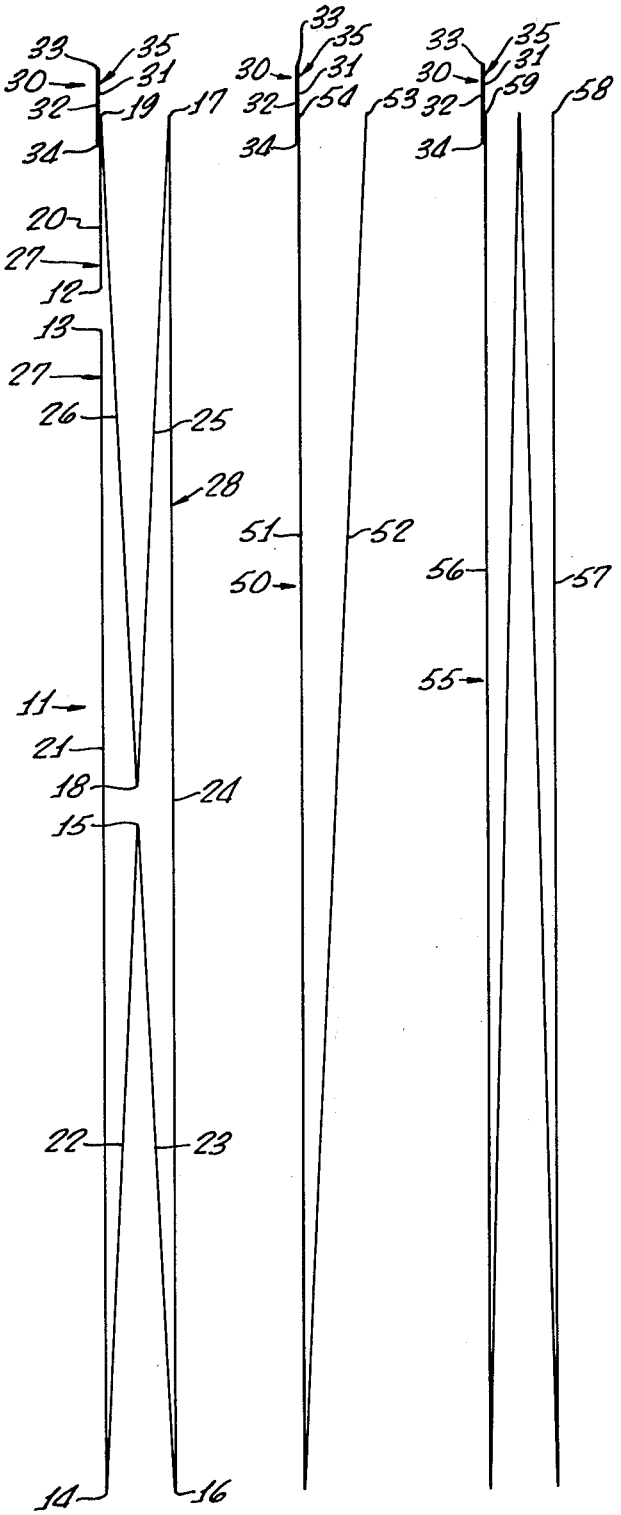
FIG. 2. (a) (b) (c)

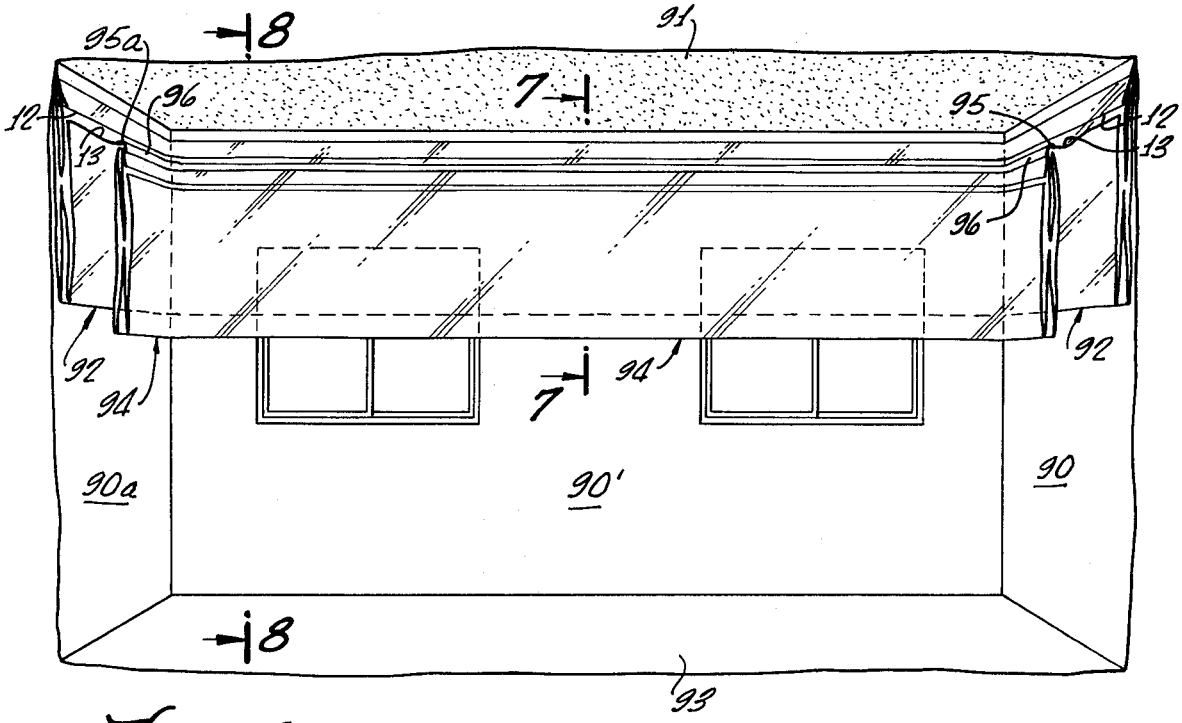
FIG. 6.
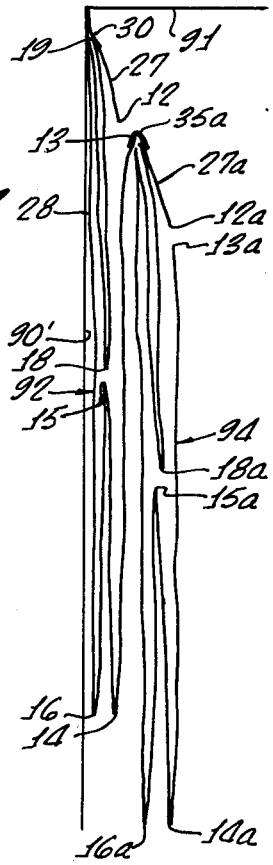
FIG. 7.
FIG. 8.
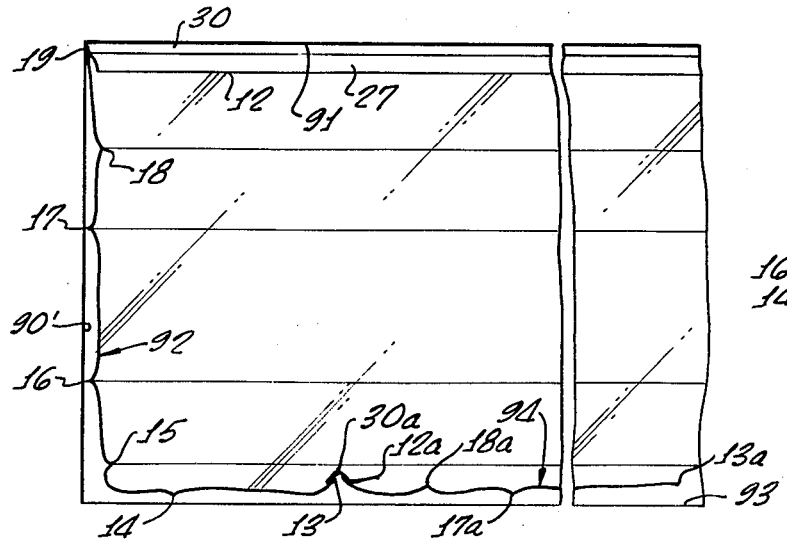

APPARATUS AND METHOD FOR MASKING SURFACES

BACKGROUND OF THE INVENTION

This invention relates to protective masking of surfaces prior to the application of a material to adjacent surfaces, and more particularly to masking of the walls or walls and floor in a room prior to the spray application of acoustic plaster and the like to the ceiling.

The spray application of acoustic plaster or similar coatings to a ceiling necessitates the careful, thorough and complete protective masking of all other room surfaces prior to the spraying operation. In the past, such masking has been a particularly inefficient, time-consuming and awkward task and a long-felt need for an improved method and apparatus has existed.

The material ordinarily used to mask the walls and floor of a room whose ceiling is to be sprayed is a sheet of plastic film formed in a width wider than the height of walls commonly encountered. As an example, the normal height of walls (i.e., in offices or residences) is in the approximate range of from 7 to 9 feet, while a common width of the plastic film is 12 feet. For ease in transporting and handling the material, it is usually furnished to the acoustic ceiling contractor by the manufacturer in rolls having widths substantially less than the width of the material itself. This roll width reduction is accomplished by forming one or more lateral folds in the sheet (which may be several hundred feet long) along its length prior to longitudinally rolling the folded sheet around a cardboard tube. A variety of lateral fold patterns may be employed to reduce the width of the sheet prior to rolling. A common roll length (using a 12-foot wide sheet) is 3 feet.

Under a method commonly used to mask the walls in a room, the masking worker first unrolls and cuts from the roll a length of the folded material somewhat longer than the perimeter of the room to be sprayed. Without unfolding the detached length, he then positions it on the floor causing the folded material to extend completely around the room at the base of the walls.

In order to reach the top edges of the walls, the worker must attach multilegged stilts to his feet. However, once these stilts are attached, the worker cannot reach the floor when standing on them. For this reason, prior to attaching the stilts he must temporarily secure a corner of the masking material to a wall (well above the floor) so that he can reach the detached material after attaching the stilts.

After attaching the stilts, the worker (making a second trip around the room) secures a continuous length of masking tape to the walls around the perimeter of the room at the intersection between the walls and ceiling. Only a top portion of the tape is attached to the walls. The bottom portion must be left unsecured for subsequent attachment of a longitudinal edge of the masking sheet between the walls and this unsecured taped portion.

When the worker returns to the starting point of his taping operation he must make yet a third journey entirely around the room (on stilts) to lift and attach the masking sheet along the walls. The temporarily attached corner of the masking sheet is removed from the wall and lifted to the unsecured portion of the tape. Then the longitudinal edge of the masking sheet containing the previously attached corner is progressively tucked under the unsecured portion of the tape and attached thereto as the worker moves around the room for the third time. Extreme care must be taken in this phase of the wall masking operation to assure that there are no gaps left between the tape and the upper edge of the masking sheet which would later allow the sprayed material to contact the wall beneath the gap. Additionally, during the initial portion of this lifting-tucking-attaching operation, care must be exercised not to let the masking sheet fall to the floor where it cannot be reached without the worker removing his stilts.

It should be noted that under the prior method of masking walls described above, it is not feasible for one worker, without an assistant, to simultaneously attach the masking material and tape along a wall, thus the time-consuming separate taping and attaching steps are required.

Another problem encountered in the prior method arises from the nature of the masking material itself. Due to economic factors and because the masking tape will hold only a limited weight, the masking sheet is very thin (a common thickness being on the order of 0.00075") and thus can be difficult to manage when any appreciable length is unrolled, due to its extreme pliancy. This inherent problem can manifest itself acutely when the folded material is unrolled around the room prior to the taping step. The roll is usually carried around the room while the worker unrolls the material and deposits it along the walls. Because of its pliancy, the unrolled material has a marked tendency to become twisted and unfolded during such unrolling. This tendency often hinders the worker when he later attempts to lift an edge of the sheet up to the attached tape. Even a single twist in the unrolled material can greatly retard the attaching operation—sometimes to the point of requiring the worker to remove his stilts and again move around the room to untwist and untangle the folded sheet.

In masking the floor of the room (which may be accomplished before or after the masking of the walls), the worker unrolls and detaches one ore more lengths of the folded material (depending on the dimensions of the room) and unfolds the material across the floor. A situation often encountered is where one dimension of the room is greater than the width of the masking sheet. This situation requires that two (or more) lengths of material be used and results in an area of overlap between the unfolded sheets on the floor. This overlap area provides a potential area through which the sprayed material may enter during spraying. Because of this, the "opening" between the two sheets must be sealed (i.e., with tape) before spraying or the sprayer (whose attention is primarily on the ceiling during spraying) must exercise great care not to kick one sheet away from the other sheet while moving around the room, thus exposing the floor during spraying. Additionally, the unrolled material tends to twist and tangle prior to unfolding, just as in the wall masking operation. The described procedure is further complicated by the not unusual presence of furniture and other equipment in the room to be masked. Such furniture and equipment (for instance in existing areas being remodeled) is not ordinarily removed during the spraying operation. It thus must also be thoroughly and completely masked—usually by running the floor masking material along the floor, up over the furniture, back down to the floor, etc. It additionally constitutes "barriers" which must be maneuvered around by the worker (usually on stilts) during his several trips around the room.

When the difficulty and inefficiency in the masking of a single room under the prior method is multiplied by the several or many rooms often encountered in a masking and spraying project, it becomes apparent that an improved method and apparatus is needed—both for economic reasons and to improve the effectiveness of the masking effort.

Accordingly, it is an object of this invention to enable application of masking material in a simple and efficient manner that eliminates or minimizes above-mentioned problems.

SUMMARY OF THE INVENTION

In carrying out principles of the present invention in accordance with a preferred embodiment thereof, an elongated sheet of masking material is laterally folded along its length to form a folded sheet having the same length as the nonfolded sheet but a substantially narrower width. Means for securing the folded sheet to a surface to be covered are attached along an outer longitudinal edge of one side of the folded sheet. The securing means thus attached enables the outer longitudinal edge of the folded sheet to be secured to the surface to be covered so that subsequent to such securing, a portion of the folded sheet may be unfolded away from the securing means and attached portion of the folded sheet.

The folded sheet and attached securing means are longitudinally rolled from one end of the folded sheet to form a cylinder having an axial opening extending longitudinally therethrough, the rolled securing means defining one end of the cylinder, and being rolled upon itself helps to maintain the material in rolled condition. The cylinder is rotatably supported on supporting means which are attached to the upwardly projecting legpiece of one of a pair of stilts worn by the masking worker. The supporting means positions the roll of folded material in a generally vertical position, with the end of the roll containing the securing means facing upwardly, alongside the body of the worker. Because the roll is supported by one of the stilts, and moves with the worker's body, his hands and arms are left entirely free during such movement to perform the masking operation.

Under a method embodying principles of the present invention, the worker attaches the stilts and supporting means and mounts a roll of the folded material, with its attached securing means, on the supporting means. While moving along the walls in a room, the worker simultaneously unrolls the folded material and attaches the securing means thereof along the top edge of the walls. When the securing means has been thus attached around the entire perimeter of the room, the worker severs the unrolled length of folded material from the roll and unfolds the unrolled material downwardly along the walls from the attached securing means by pulling the free longitudinal edge of the attached folded sheet downwardly.

To additionally mask the floor of the room the worker (while still on stilts) simultaneously unrolls a second length of the folded material and attaches its securing means to the free edge of the attached first length of the folded material across one wall. The second length is then cut from the roll and is unfolded across the floor, carrying with it a lower portion of the first length of the folded material.

The use of the method and apparatus of the present invention yields great advantages over prior methods of masking the walls in a room. All of the walls in a room can be masked in a single trip around the room by a single masking worker. Since the securing means are an integral part of the roll, no time-consuming additional trips are required to attach the securing means to the wall and then separately attach the masking material to the securing means, and no helpers are needed. Additionally, much less skill and care is required on the part of the masking worker because of the reduction in the number of steps required. Further, because during the unrolling of the folded material only relatively short lengths of unrolled material (between the roll and the last point of attachment to the wall) are handled at any given time, the handling of the extremely pliant masking material is greatly facilitated.

The apparatus of the present invention may be readily and inexpensively mass produced yet yields substantial savings in time and labor costs in use, while markedly improving the quality of the masking job.

BRIEF DESCRIPTION OF THE DRAWINGS

FIG. 1 is a perspective view of a roll of laterally folded, pretaped masking material embodying principles of the present invention, showing a portion of the folded material and attached tape unrolled from the roll;

FIG. 2*a* is a cross-section through the folded masking material, taken along line 2*a*—2*a* of FIG. 1;

FIGS. 2*b* and 2*c* are similar to FIG. 2*a*, but illustrate representative alternate lateral fold patterns in the folded material;

FIG. 6 is a perspective view of a portion of a room, illustrating a method for masking both the walls and the floor of a room;

FIG. 7 is an enlarged cross-sectional view through the two attached lengths of pretaped, folded material shown in FIG. 6, and is taken along line 7—7 of FIG. 6; and FIG. 8 is a cross-sectional view through the two attached lengths of material shown in FIG. 6, after unfolding of the second length to mask the floor, and is taken along line 8—8 of FIG. 6.

DETAILED DESCRIPTION

Figure 4:
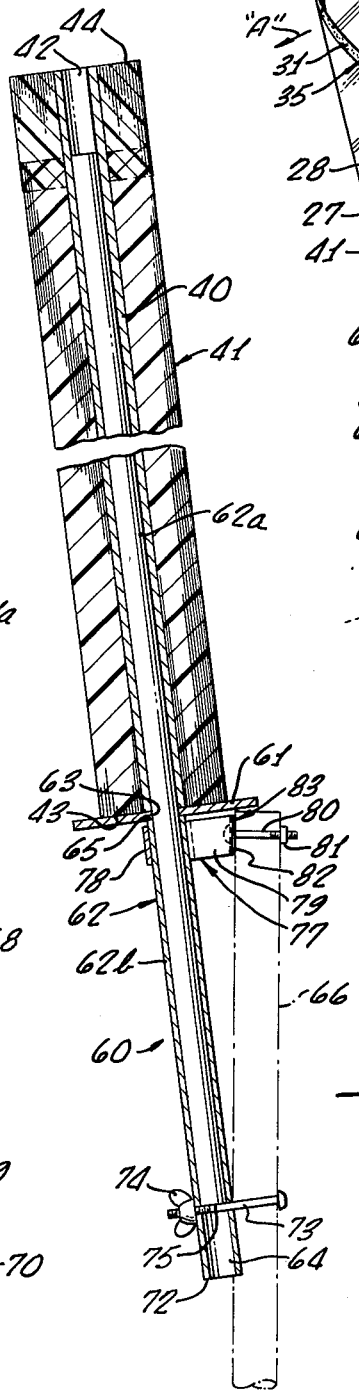
FIG. 4 is a longitudinal cross-section of an assembled roll and dispenser of the present invention.

Referring first to FIGS. 1, 2*a* and 4 of the drawings, an elongated covering sheet 10 of masking material is laterally folded along its length to form a folded sheet 11 having, under a currently preferred embodiment of this invention, a transverse cross-section as indicated in FIG. 2*a*. (As used herein, the term "laterally folded" means folded from a side and along a longitudinally extending fold line). The covering sheet 10 has longitudinally extending or side edges 12 and 13 and is preferably of a plastic material having a thickness of approximately 0.00075". Other thin and flexible sheets of masking material may be employed.

The folded sheet 11 has longitudinally extending edges 12 through 19 (edges 12 and 13 being the side edges of the covering sheet 10, and edges 14 through 19 being folded edges of the folded sheet 11) and lateral folds (folded sheet portions) 20 through 26. Each fold or folded sheet portion comprises a section of the covering sheet extending longitudinally for the full length of the material and laterally between a pair of folded edges or between a folded edge and a side edge of the covering sheet. Folds 20 and 21 comprise oppositely disposed outer lateral portions of the covering sheet 10 and define a first side 27 of the folded sheet 11; fold 24 comprises a central lateral portion of the covering sheet 10 and defines a second side 28 of the folded sheet 11; and folds 22, 23, 25 and 26 comprise intermediate lateral portions of the covering sheet 10 and form oppositely facing gusset folds between the first side 27 and the second side 28 of the folded sheet 11, with edge 15 being adjacent edge 18.

In a preferred embodiment, fold 20 is substantially narrower than fold 21 and edges 12 and 13 are adjacent each other and edge 19 of the folded sheet 11. Hereinafter, edge 13 will be referred to as the "free edge" of the folded sheet 11, and edges 14, 16, 17 and 19 will be referred to as the "outer" longitudinal edges of the folded sheet 11, with the edges 14 and 19 and the edges 16 and 17 being, respectively, the outer longitudinal edges of the first and second sides, 27 and 28, of the folded sheet 11. Edge 19 may also be referred to as the "fastening edge" of the folded sheet 11.

Securing means in the form of a securing strip of tape 30 having an adhesive side 31, a nonadhesive side 32, and substantially straight longitudinal edges 33 and 34, is attached to the outer surface of the first side 27 of the folded sheet 11 along the outer longitudinal edge 19 with the adhesive side 31 of the tape 30 facing inwardly. Longitudinal edge 33 and a securing portion 35 of the tape 30 project laterally beyond edge 19 of the first side 27 of the folded sheet 11.

The folded sheet 11 and attached tape 30 are longitudinally rolled ("longitudinally rolled", as used herein, meaning rolled from an end of the folded sheet about an axis perpendicular to the longitudinal extent of the folded sheet and parallel to a surface thereof) around an elongated tube 40 (preferably cardboard), with the second side 28 of the folded sheet 11 facing inwardly, to form a cylinder or roll 41 having an axial opening 42 extending longitudinally therethrough. The roll 41 has a lower end 43 and an upper end 44 which is defined by edge 33 of the tape 30. When the roll 41 is formed, the adhesive side of the securing portion 35 of the tape 30 adheres only to the nonadhesive side of the adjacent securing portion of the tape. Unexpectedly, this precludes undesired unrolling of the folded sheet 11 from the roll 41 yet permits easy unrolling when desired. Thus, the pretaped material is not only more easily attached to the wall in a single operation, but is more easily handled both before and during such attachment.

The covering sheet 10 is customarily manufactured by extruding a thin plastic film in elongated, tubular form. Lateral folds are formed in the tube so as to form the folded sheet 11. The folded sheet 11 is then longitudinally wrapped around a hollow cylindrical member to form a roll (not shown). During the wrapping process, a longitudinal slit is made along the outer fold of the folded sheet. This creates the longitudinal edges of the "covering sheet". The roll is then sold to purchasers, such as building contractors, for use in various masking operations. As discussed subsequently, a variety of lateral fold patterns may be imparted to the extruded film during the manufacuring process.

In constructing the roll 41 of the illustrated embodiment of this invention, the folded sheet 11 is unrolled from the manufactured roll of prefolded plastic film and the tape 30 is attached along the outer longitudinal edge 19 as previously described. The folded sheet 11 and the attached tape 30 are then rerolled around the elongated tube 40 to form the roll 41 of the present invention. The film is moved from the manufactured roll to the folded sheet roll 41 in a manner analogous to moving a typewriter ribbon from one roll to another. As a relatively short length of film is withdrawn from the manufactured roll, the tape is applied and then the taped film is rewound. Thus a long unrolled section of folded film need never be handled until it has been attached to a wall. While this attachment of the tape 30 along the edge 19 may be accomplished by hand, it should be apparent to one skilled in the art that a wide variety of machines of various types could also be employed. Such machines would be preferred in preparation of large quantities of pretaped rolls.

As previously mentioned, a variety of lateral fold patterns are usually available from the manufacturer of the prefolded plastic film. Frequently, however, the availability of certain fold patterns is dependent upon the quantity of material ordered. FIGS. **2*b* and 2*c*** illustrate two alternate fold patterns which may be employed in the present invention. It should be clearly understood, however, that the particular alternate fold patterns illustrated are merely representative of the many fold patterns available for and usable with the present invention and are not intended as an inclusive listing thereof.

FIG. **2*b* illustrates one of the many alternative fold patterns—commonly known as a "J" fold. Alternate folded sheet 50 has a first side 51, a second side 52, a free edge 53, and an outer longitudinal edge 54 on the first side 51 along which the tape 30 is attached. FIG. 2*c* shows yet another alternate fold pattern—commonly known as the "M" fold. Alternate folded sheet 55 has a first side 56, a second side 57, a free edge 58, and an outer longitudinal edge 59 on the first side 56 along which the tape 30 is attached. For the sake of clarity, the parts denoted by reference numerals 31 through 35 in FIGS. 2*b* and 2*c* are the same parts of the tape 30 of FIG. 2*a***.

It should be noted that in the fold pattern indicated in FIG. **2*a*, edge 19 is a folded edge and the adhesive side 31 of the tape 30 contacts the fold 20. Fold 20 is not needed and, in its absence, the tape 30 could be attached to fold 26 along edge 19 (which would then be a side edge of the covering sheet 10). Fold 20 is shown in FIG. 2*a* merely because it is present (and economically unavoidable) in the rolls of folded material presently available. Where fold patterns similar to those shown in FIGS. 2*b* and 2*c* are used, however, the tape 30 may be applied directly to the first side (51 or 56) along the nonfolded edge (54 or 59**).

Figure 3:
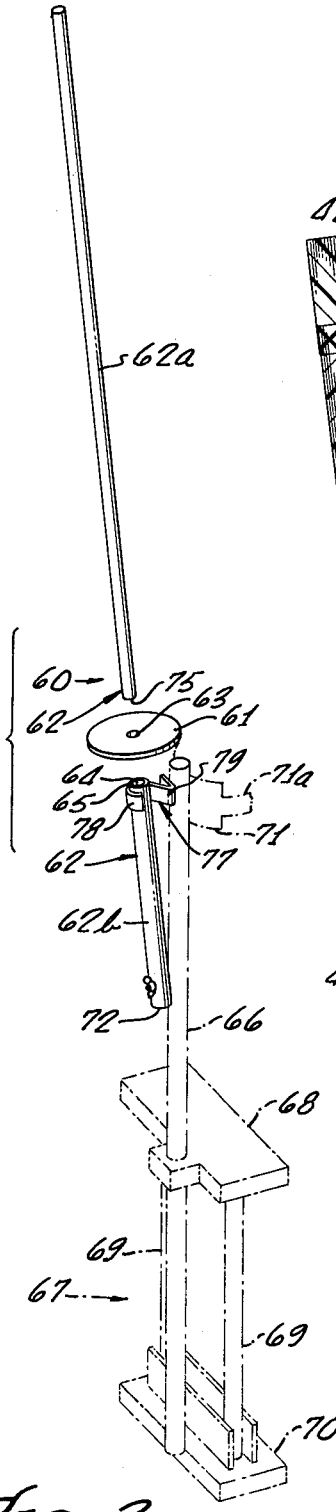
FIG. 3 is an exploded perspective view of a dispenser for use with the masking material roll of FIG. 1, shown attached to a stilt.

Referring now to FIGS. 3 and 4, the roll 41 is rotatably supported on a roll supporting reel or dispenser 60 which has a roll supporting plate or disc 61 which is rotatably mounted on an intermediate portion of a reel pole 62. The reel pole 62 has a first end portion or upper cylindrical section **62*a* and a substantially shorter second end portion or lower cylindrical portion 62*b*. The disc 61 and the reel pole sections 62*a* and 62*b* are dimensioned so that the section 62*a* passes freely through an opening 63 in the disc 61 and thence into an opening 64 extending longitudinally through section 62***b* as seen in FIG. 4. Section 62*a* is dimensioned to pass freely through the axial opening 42 of the roll 41. The opening 63 in the disc 61 is substantially smaller than the diameter of section 62*b*. Thus, as seen in FIG. 4, the upper end 65 of the lower section 62*b* of the reel pole 62 acts as an abutment when the dispensser 60 is assembled, precluding the disc 61 (and thus the roll 41) from moving downwardly (in FIG. 4) past the upper end 65.

The lower section 62*b* of the reel pole 62 is secured to an upwardly projecting member or legpiece 66 of one of a pair of stilts 67 of the type worn by masking workers to enable them to reach the top of walls during the masking operation. (The legpiece 66 and stilts 67 are indicated in FIGS. 3 and 4 by dashed lines and are representative of several types of such stilts presently commercially available). Stilt 67 in FIG. 3 has a foot platform 68 adapted to receive and support the foot of a worker. The platform 68 is supported by legs 69 extending downwardly therefrom and secured to a base member 70 which contacts the floor when the stilt 67 is used. Stilt 67 is fastened to the leg of a worker by strapping a curved attachment member 71 (secured to the upper end of the legpiece 66) to the leg of the worker by strap 71*a*.

Section 62*b* of the reel pole 62 (and thus the reel pole 62 and the roll 41) are supported from the legpiece 66 generally vertically, but at an acute angle thereto (preferably approximately 15 degrees). The lower end 72 of section 62*b* is attached to the legpiece by bolt 73 which passes through section 62*b* and through the legpiece 66, and nut 74. As seen in FIG. 4, the bolt 73 supports the lower end 75 of section 62*a* to prevent section 62*a* from sliding out the lower end 7 of section 62*b*.

The upper portion of section 62*b* is attached to and spaced apart from the legpiece 66 by a spacing member 77 which thus holds the reel pole 62 in a position inclined slightly outwardly from the side of the worker. Spacing member 77, in a preferred embodiment, is a strip of metal which has a first longitudinally curved portion 78 which is press fit around section 62*b* adjacent its upper end 65, and a second longitudinally curved portion 79 (curving in an opposite direction to that of the first portion 78) which is attached to the legpiece 66 by bolt 80 and nut 81. An outer portion 82 of the second curved portion 79 is bent at a slight angle (preferably about 15 degrees) with respect to the width of the spacing member 77 so that when the dispenser 60 is attached to the legpiece 66, the outer surface 82 of the outer portion 82 is parallel to the legpiece 66.

Referring to FIG. 4, the lower end 43 of the roll 41 is supported by the disc 61. Although the lower section 62*b* of the reel pole 62 is precluded from rotation, the disc 61 and the upper section 62*a* of the reel pole 62 are free to rotate with respect to the lower section 62*b* as the roll 41 is unrolled. It should be apparent to one skilled in the art that although the reel pole 62 is in the illustrated embodiment is formed in two section to support and permit relative rotation of the disc 61 with respect thereto, a variety of other construction methods could be employed to obtain the same result.

Figure 5:
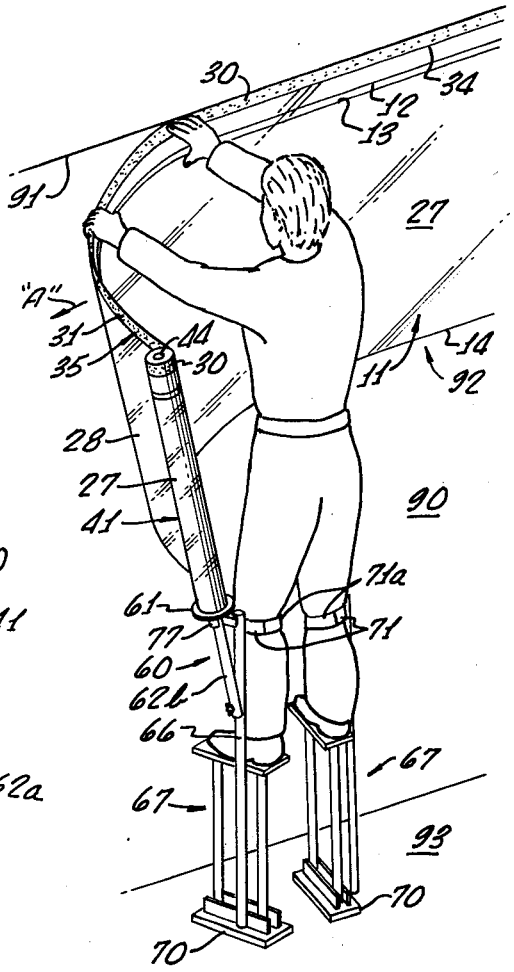
FIG. 5 is a perspective view of a roll and dispenser in use, showing a masking worker using the roll and dispenser apparatus in masking a wall.

FIG. 5 illustrates a part of a preferred embodiment of the method of the present invention, showing a worker using the apparatus to implement the method of this invention in the masking of a wall 90. The roll 41 is mounted on the dispenser 60 which is attached to the legpiece 66 of one of the stilts 67 as previously described. The worker is shown using a 36 inch long roll of plastic film. (This is the length of a commonly manufactured roll, the roll being formed from plastic film having a width of 12 feet and then folded, rolled, pretaped and rerolled as described above). Using the 3-foot roll, the upper end 44 (i.e., the pretaped end) is positioned by the dispenser 60 at approximately the level of the worker's shoulder. The angle imparted to the roll 41 by the spacing member 77 positions the upper end 44 of the roll 41 conveniently away from the worker's left shoulder (see FIG. 5), thus permitting free movement thereof during the masking operations. For purposes of the following description, it is to be assumed that the folded sheet 11 of the roll 41 has a lateral fold pattern as indicated in FIG. 2*a* of the drawings.

To mask a wall 90 in a room, the worker (wearing stilts 67) moves along the wall 90 (in the direction indicated by arrow "A"), simultaneously unrolling the folded sheet 11 from the roll 41 and attaching the securing portion 35 of the tape 30 (and thus a first portion of the folded sheet 11) to the wall 90 along the juncture 91 between the ceiling and the wall 90. In FIGS. 1 and 5, the tape 30 and folded sheet 11 (as viewed from the top in FIGS. 1 and 5) are rolled in a counterclockwise direction. It is thus necessary for the worker to move to the left (direction "A") in FIG. 5 so that the adhesive side 31 of the tape 30 faces the wall 90 as he moves along it while unrolling and attaching the folded sheet 11. It is preferable that the roll 41 be positioned on the left side of the worker in FIG. 5. If it were positioned on his right side he would have to reach around the roll 41 (instead of between the roll 41 and the wall 90 as indicated) to unroll and attach the folded sheet 11 along the wall 90 (while moving to his left). If it is desired to mask the wall 90 while moving from left to right, the roll 41 should be formed so that (again as viewed from the top in FIGS. 1 and 5) the tape 30 and folded sheet 11 are rolled ina clockwise direction—thereby forming (with respect the roll 41) a "reversed" roll. The reversed roll and dispenser 60 would then be positioned on the right side of the worker in FIG. 5 and the masking operation illustrated therein could be performed from left to right—the adhesive side 31 of the tape 30 still facing the wall 90 as the folded sheet 11 is unrolled from the reversed roll.

Since the roll 41 and the dispenser 60 are supported by the legpiece 66 and move along the wall 90 with the worker, his hands and arms are left entirely free to unroll and secure the folded sheet 11 along the wall 90. When the securing portion 35 of the tape 30 is attached to the wall 90 around the entire perimeter of the room, the unrolled portion (or first length 92) of the folded sheet 11 is detached from the portion of the sheet remaining on the roll 41 and the free edge 13 of the attached portion of the folded sheet 11 is pulled downwardly along the wall 90, unfolding the remainder or second portion of the folded sheet 11 along the wall 90 and completely masking it. To mask all of the walls in a room, the folded sheet 11 is attached to the walls completely around the room before the first length 92 is cut from the roll.

The method shown in FIG. 5 may be partially repeated in a room to additionally mask the floor 93. Referring to FIG. 6 of the drawings, the first length 92 of the folded sheet 11 is shown attached to the walls around the entire perimeter of a room as previously described, but not yet unfolded.

To mask the floor 93 of a room, a second length 94 of the folded sheet 11 is unrolled from the roll 41 and attached to the free edge 13 of the first length 92 along a selected wall 90' of the room while the worker (on stilts) is moving along the wall 90' as previously described. This attachment is started at point 95 along wall 90 (in FIG. 6) adjacent wall 90', proceeds along wall 90', and terminates at point 95a along the opposite wall 90a a short distance from wall 90'. The second length 94 is then cut from the roll 41.

FIG. 7 is a transverse cross-section through the attached first and second lengths 92 and 94. For the sake of clarity, the features of the second length 94 have been given the same reference numerals as those given to corresponding features of the first length 92, except that the suffix "a" has been added. Thus, for example, the free edge of the first length 92 is designated by the number 13, while the free edge of the second length 94 is designated by the numeral 13a. The second length 94 is attached to the first length 92 by folding the securing portion 35a of the tape 30a (adhesive side inward) over the free edge 13 of the first length 92. This is done to assure that a leakproof seal is formed between first and second lengths 92 and 94. After the two lengths 92 and 94 are attached, the worker pulls the free edge 13a of the second length 94 away from the wall 90' and across the floor 93 as indicated in FIG. 8. THe second length 94 and a lower portion of the first length 92 are thus unfolded across the floor 93.

In masking the walls and floor of a room, the wall masking material should overlap the upper surface of the floor masking material to prevent the sprayed material from running down the wall masking material and then under the floor masking material onto the floor. The portion 96 of the second length 94 extending beyond wall 90' facilitate the proper orientation of the wall material and floor material as the free edge 13a is pulled across the room. As this is done, the portions 96 pull a portion of the free edge 13 of the first length 92 over the portions of the first and second lengths 92 and 94 protecting the floor 93.

The illustrated and described method and apparatus of the present invention permit a worker to completely mask the walls and floor of a room in a fraction of the time required under prior methods in addition to improving the quality of the masking. The apparatus may be inexpensively produced using simple materials which are readily available. In addition to these economic benefits, the extremely pliant plastic film (which under prior masking methods has a marked tendency to twist and tangle when unrolled in long lengths) is rendered surprisingly manageable under the preferred method of this invention which secures it to the wall as it is unrolled. Extremely little difficulty in this regard is encountered—even when the film is only 0.00075" thick. Even if the unrolled material begins to unfold during attachment to a wall, it unfolds exactly in the desired direction—down the wall.

Also, and quite unexpectedly, the pretaping of the folded sheet, prior to rerolling, yields an additional benefit (besides greatly reducing the time required to mask walls and floors). Because the adhesive side of the securing portion of the tape on the roll contacts the nonadhesive side of the adjacent securing portion, the folded film remains rolled until the worker wants to unroll it. Unlike rolls of nontaped material, dropping or kicking the preptaped roll during use will not cause it to unroll. However, because the adhesve side of the securing portion contacts only the nonadhesive side of the adjacent securing portion of the tape in the roll (and not adjacent plastic or adhesive) the folded film can be easily unrolled by the worker when desired. Finally, even a sharp jerk on the loose end of the rolled pretaped film does not cause an unwanted amount of film to uncontrollably spin off of the roll on the dispenser. Because of the tape, as soon as the pulling stops, the unrolling stops.

The foregoing detailed description is to be clearly understood as given by way of illustration and example only, the spirit and scope of this invention being limited solely by the appended claims.

I claim:

1. A device for use in covering a surface, said device comprising:

(a) an elongated covering sheet laterally folded along the length thereof to form a folded sheet having first and second sides defined by folds thereof, and having longitudinally extending edges, said folded sheet being longitudinally rolled, and (b) securing strip means on said folded and rolled sheet and rolled therewith for securing a first portion of said folded sheet to said surface as said folded sheet and securing strip means are unrolled, whereby after said first portion is secured to said surface a second portion of said folded sheet may be unfolded to increase the extension thereof from said first portion secured to said surface.

2. A device as recited in claim 1 wherein said rolled sheet has an outer surface formed by said first side, wherein said securing strip means is fixed to said outer surface, and wherein said folded sheet is rolled with the second side thereof facing inwardly and with at least some of said folds facing outwardly.

3. A device as recited in claim 2 wherein said securing strip means has an adhesive substance upon an inwardly facing side thereof for holding said folded sheet in rolled condition and for attaching said strip means and sheet to said surface as said folded sheet is unrolled.

4. A device as recited in claim 3 wherein said securing strip means is a strip of tape having an adhesive side and a nonadhesive side, a lateral portion of said adhesive side being attached to said first side of said folded sheet.

5. A device as recited in claim 4 wherein said outer longitudinal edge of said first side of said folded sheet is a folded edge thereof.

6. The device of claim 4 including a supporting member adapted to be connected to and move with a person applying said masking material, said rolled sheet having a roll axis, and means on said supporting member for rotatably carrying said rolled sheet with said roll axis extending upwardly and inclined outwardly from said supporting member with said tape at an upper end of said rolled sheet.

7. A device as recited in claim 1 wherein said covering sheet is of a plastic material.

8. A device as recited in claim 7 wherein said plastic material is a film having a thickness of approximately 0.00075 inches.

9. A device as recited in claim 1 wherein said folded sheet contains a pair of oppositely disposed gusset folds between said first and second sides thereof.

10. A device as recited in claim 9 wherein said first side of said folded sheet is defined by first and second lateral portions of said covering sheet, each of said lateral portions containing a longitudinal edge of said covering sheet, said first and second lateral portions of said covering sheet being folded inwardly so that one of said longitudinal edges of said covering sheet is adjacent the other of said longitudinal edges thereof.

11. A device as recited in claim 10 wherein said first lateral portion of said covering sheet is substantially narrower than said second lateral portion thereof.

12. A method of constructing a roll of masking material for use in masking areas including a vertical surface, said method comprising the steps of:

(a) providing an elongated, laterally folded, sheet of masking material having a pair of sides, and having longitudinally extending edges, (b) attaching a strip of adhesive tape to said folding sheet along one of said edges with a longitudinal portion of said tapes extending beyond said sheet and outwardly of said one edge, and (c) longitudinally rolling said folded sheet and said attached tape to form a cylindrical roll of pre-taped masking material.

13. A roll of masking material made by the method of claim 12.

14. The method of claim 12 wherein said step of longitudinally rolling said sheet and tape comprises rolling said tape upon itself to cause an adhesive side of the tape to contact a non-adhesive side to thereby hold said cylindrical roll in rolled condition.

15. Apparatus for use in covering a surface including a vertical surface, said apparatus comprising:

(a) an elongated covering sheet laterally folded along the length thereof to form a folded sheet having first and second sides defined by at least one fold thereof, and having longitudinally extending edges, (b) means fixed to said folded sheet for securing a first portion thereof along said vertical surface whereby subsequent to said securing, a second portion of said folded sheet may be unfolded to increase the extension thereof from said first portion, said folded sheet and said securing means being longitudinally rolled together to form a cylindrical roll, (c) means for rotatably supporting said roll in a generally vertical position adjacent the upright body of a person for movement therewith along said vertical surface, whereby during said movement the hands and arms of said person are free to unroll said folded sheet and attach said first portion thereof along said vertical surface.

16. Apparatus as recited in claim 15 wherein said first side of said folded sheet contains a fastening edge defined by an outer longitudinal edge of said first side, wherein said securing means (b) includes a securing strip attached to said folded sheet along said fastening edge, said securing strip having a substantially straight longitudinal edge that projects laterally beyond said fastening edge; and wherein said folded sheet and attached securing strip are longitudinally rolled with said second side of said folded sheet facing inwardly.

17. A method of masking an area including a vertical surface, said method comprising the steps of:

(a) rotatably supporting, in a generally vertical position, a roll of masking material adjacent a side portion of the upright body of a person for movement therewith along said vertical surface whereby during said movement therewith the hands and arms of said person are left free to unroll a length of said material from said roll and to attach a portion of said length along said vertical surface, (b) unrolling a length of said material from said roll supported in said position, and (c) securing an upper portion of said length of said material along said vertical surface.

18. A method as recited in claim 17 including the steps of attaching a strip of tape along a longitudinal edge of said masking material with a lateral edge portion of said tape extending laterally outwardly along said longitudinal edge of said masking material, and longitudinally rolling said tape together with said masking material to form said roll with an adhesive side of said tape facing inwardly, said tape defining a tape end of said roll, wherein said supporting step (a) includes positioning said roll with said tape end thereof facing upwardly, and wherein during said movement along said vertical surface and during said unrolling and securing steps (b) and (c) the adhesive side of the tape on said unrolled length of said masking material faces said vertical surface.

19. A method as recited in claim 17 wherein said material is laterally folded and wherein said method additionally comprises the steps of:

(d) unfolding a lower portion of said length of said material along said vertical surface.

20. A method as recited in claim 17 wherein said supporting step (a) includes supporting said roll of material from an upwardly projecting portion of stilt means adapted to be secured to a leg of said person.

21. A method as recited in claim 20 wherein said supporting step (a) further includes positioning said roll of material at an acute angle with respect to said stilt means with the lower end of said roll of material being closer thereto than said upper end.

22. A method of masking a wall and a portion of the floor in a room, said method comprising the steps of:

(a) providing a roll of laterally folded covering material, said folded material having a longitudinal fastening edge with adhesive means secured thereto and a longitudinal free edge that may be extended away from said fastening edge upon an unfolding of said folded material;

(b) rotatably supporting said roll in a generally vertical position upon and at the side of the upright body of a person for movement therewith along a wall in said room whereby during said movement the hands and arms of said person are left free to unroll a length of said folded material and attach said adhesive means to said wall;

(c) unrolling a first length of said folded material from said roll;

(d) attaching the adhesive means of said first length along the upper edge of a wall in said room;

(e) detaching said first length from said roll;

(f) unrolling a second length of said folded material from said roll;

(g) joining said first and second lengths by attaching the adhesive means of said second length along the free edge of said first length;

(h) detaching said second length from said roll; and (i) unfolding a portion of said second length away from said wall across said floor.

23. Apparatus for masking surfaces, said apparatus comprising:

(a) stilt means for increasing the vertical extension of the body of a person from a surface, said stilt means having an upwardly projecting member to be attached to a leg of said person;

(b) a roll supporting reel having an elongated reel pole and a roll supporting plate rotatably carried by an intermediate portion thereof;

(c) means for attaching an end portion of said reel pole to said upwardly projecting member of said stilt means so that said reel pole extends upwardly from said end portion at an acute angle to said upwardly projecting member of said stilt means; and (d) a device as described in claim 1 rotatably mounted on said roll supporting reel.

24. The method of claim 12 wherein said step of longitudinally rolling comprises rolling said sheet with its folds facing outwardly.

* * * * *

REEXAMINATION CERTIFICATE (1109th)

United States Patent [19] [11] B1 4,263,347

Banta [45] Certificate Issued Aug. 1, 1989

[54] APPARATUS AND METHOD FOR MASKING SURFACES

[75] Inventor: Maynard A. Banta, Los Alamitos, Calif.

[73] Assignee: Minnesota Mining and Manufacturing Company, St. Paul, Minn.

Reexamination Request:
No. 90/001,393, Dec. 7, 1987

Reexamination Certificate for:

| | |
|---|---|
| Patent No.: | **4,263,347** |
| Issued: | **Apr. 21, 1981** |
| Appl. No.: | **22,857** |
| Filed: | **Mar. 22, 1979** |

[51] Int. Cl.[4] ..... B05D 1/32

[52] U.S. Cl. ..... 427/282; 118/505; 156/71; 156/187; 156/192; 156/247; 156/280; 156/324; 156/574; 156/577; 206/389; 206/813; 428/194; 428/906

[58] Field of Search ..... 427/282; 118/505; 156/71, 187, 247, 280, 324, 574, 577; 206/389, 813; 428/12, 194, 906

[56] References Cited

FOREIGN PATENT DOCUMENTS

| | | |
|---|---|---|
| 48-094850 | 11/1973 | Japan . |
| 49-115458 | 10/1974 | Japan . |
| 50-066923 | 11/1976 | Japan . |
| 51-147163 | 11/1976 | Japan . |
| 52-106469 | 8/1977 | Japan . |

*Primary Examiner*—Janyce Bell

[57] ABSTRACT

A roll of pretaped, laterally folded masking material is mounted on a dispenser which is attached to the leg-piece of one of a pair of stilts worn by masking workers. When the stilts are secured to the feet and legs of a worker, the dispenser supports the roll generally vertically alongside the worker's body with the taped end of the roll facing upwardly and positioned approximately at the level of his shoulder. To mask the walls in a room, the worker unrolls the folded material and fastens the tape continuously along the tops of the walls around the perimeter of the room while moving along the walls. The unrolled material is then cut from the roll and the portion below the tape attached to the walls is unfolded downwardly to completely mask the walls. To subsequently mask the floor, the worker attaches the taped edge of another length of the material along one wall to the free edge of the material already taped to that wall. The second length of material is then cut from the roll and its free edge is pulled away from the wall, unfolding the second length and a lower portion of the first length along the floor.

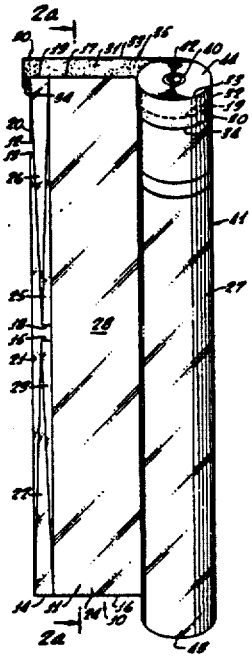

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 17, 18, and 20–22 is confirmed.

Claims 1–5, 7–14 and 24 are cancelled.

Claims 6, 15, 19 and 23 are determined to be patentable as amended.

Claim 16, dependent on an amended claim, is determined to be patentable.

6. [The device of claim 4 including] *A device for use in covering a surface, said device comprising:*

(*a*) *an elongated covering sheet laterally folded along the length thereof to form a folded sheet having first and second sides defined by folds thereof, and having longitudinally extending edges, said folded sheet being longitudinally rolled,*

(*b*) *securing strip means on said folded and rolled sheet and rolled therewith for securing a first portion of said folded sheet to said surface as said folded sheet and securing strip means are unrolled, whereby after said first portion is secured to said surface a second portion of said folded sheet may be unfolded to increase the extension thereof from said first portion secured to said surface,*

*said rolled sheet having an outer surface formed by said first side, wherein said securing strip means is fixed to said outer surface, and wherein said folded sheet is rolled with the second side thereof facing inwardly and with at least some of said folds facing outwardly, and*

*said securing strip means comprising a strip of tape having an adhesive side and a nonadhesive side, a lateral portion of said adhesive side being attached to said first side of said folded sheet for holding said folded sheet in a rolled condition and for attaching said strip means and said folded sheet to said surface as said folded sheet is unrolled, and*

(*c*) a supporting member adapted to be connected to and move with a person applying said [masking material] *covering sheet*, said rolled sheet having a roll axis, and means on said supporting member for rotatably carrying said rolled sheet with said roll axis extending upwardly and inclined outwardly from said supporting member with said tape at an upper end of said rolled sheet.

15. Apparatus for use in covering a surface including a vertical surface, said apparatus comprising:

(a) an elongated covering sheet laterally folded along the length thereof to form a folded sheet having first and second sides defined by at least one fold thereof, and having longitudinally extending edges, (b) means fixed to said folded sheet for securing a first portion thereof along said vertical surface whereby subsequent to said securing, a second portion of said folded sheet may be unfolded to increase the extension thereof from said first portion, said folded sheet and said securing means being longitudinally rolled together to form a cylindrical roll, *and*

(c) means for rotatably supporting said roll in a generally vertical position adjacent the upright body of a person for movement therewith along said vertical surface, whereby during said movement the hands and arms of said person are free to unroll said folded sheet and attach said first portion thereof along said vertical surface.

19. A method as recited in claim 17 wherein said material is laterally folded and wherein said method additionally comprises the *step* [*steps*] *of:*

(d) unfolding a lower portion of said length of said material along said vertical surface.

23. Apparatus for masking surfaces, said apparatus comprising:

(a) stilt means for increasing the vertical extension of the body of a person from a surface, said stilt means having an upwardly projecting member to be attached to a leg of said person;

(b) a roll supporting reel having an elongated reel pole and a roll supporting plate rotatably carried by an intermediate portion thereof;

(c) means for attaching an end portion of said reel pole to said upwardly projecting member of said stilt means so that said reel pole extends upwardly from said end portion at an acute angle to said upwardly projecting member of said stilt means; and (d) a device [as described in claim 1] rotatably mounted on said roll supporting reel, *said device comprising:*

*an elongated covering sheet laterally folded along the length thereof to form a folded sheet having first and second sides defined by folds thereof, and having longitudinally extending edges, said folded sheet being longitudinally rolled, and*

*securing strip means on said folded and rolled sheet and rolled therewith for securing a first portion of said folded sheet to said surface as said folded sheet and securing strip means are unrolled, whereby after said first portion is secured to said surface a second portion of said folded sheet may be unfolded to increase the extension thereof from said first portion secured to said surface.*

* * * * *